US011069314B2

(12) United States Patent
Shan

(10) Patent No.: US 11,069,314 B2
(45) Date of Patent: Jul. 20, 2021

(54) CIRCUIT BOARD WITH INTER-INTEGRATED CIRCUIT ENCRYPTION AND DISPLAY INCLUDING THE SAME

(71) Applicant: HKC CORPORATION LIMITED, Shenzhen (CN)

(72) Inventor: Jianfeng Shan, Shenzhen (CN)

(73) Assignee: HKC CORPORATION LIMITED, Shenzhen (CN)

( * ) Notice: Subject to any disclaimer, the term of this patent is extended or adjusted under 35 U.S.C. 154(b) by 0 days.

(21) Appl. No.: 16/648,789

(22) PCT Filed: Oct. 23, 2017

(86) PCT No.: PCT/CN2017/107255
§ 371 (c)(1),
(2) Date: Mar. 19, 2020

(87) PCT Pub. No.: WO2019/056452
PCT Pub. Date: Mar. 28, 2019

(65) Prior Publication Data

US 2020/0273416 A1 Aug. 27, 2020

(30) Foreign Application Priority Data

Sep. 25, 2017 (CN) ..... 201710876949.1

(51) Int. Cl.
*G09G 3/36* (2006.01)

(52) U.S. Cl.
CPC ..... *G09G 3/3648* (2013.01); *G09G 3/3611* (2013.01); *G09G 2310/08* (2013.01); *G09G 2370/08* (2013.01); *G09G 2370/10* (2013.01)

(58) Field of Classification Search
CPC .... G09G 3/3611; G09G 3/3648; G09G 5/006; G09G 2370/06; G09G 2370/10; G09G 2330/04; G09G 2310/08; G09G 2370/08
See application file for complete search history.

(56) References Cited

U.S. PATENT DOCUMENTS 8,633,883 B2 * 1/2014 Song ..... G09G 3/3696 345/95
2014/0198093 A1 * 7/2014 Nambi ..... G09G 3/3618 345/212

(Continued)

FOREIGN PATENT DOCUMENTS

CN 203070738 U 7/2013
CN 104036716 A 9/2014

(Continued)

OTHER PUBLICATIONS

First Office Action in counterpart Chinese Application No. 201710876949.1, dated Mar. 1, 2019.

(Continued)

*Primary Examiner* — Kwang-Su Yang
(74) *Attorney, Agent, or Firm* — Westbridge IP LLC

(57) ABSTRACT

The embodiments of the disclosure disclose a circuit board and a display, the circuit board includes a switch unit, the switch unit is preset with a switch-on signal, the switch unit is configured to respectively connect with the system board and the control board; when the control signal received from the system board is the same with the conduction signal, the switch unit is switched on, allowing the circuit board to receive the drive data and work normally; when the control signal received from the system board is not the same with the conduction signal, the switch unit is switched off, stopping the circuit board from receiving the drive data and resulting in stoppage of an operation.

17 Claims, 3 Drawing Sheets

(56) References Cited

U.S. PATENT DOCUMENTS

| | | | | |
|---|---|---|---|---|
| 2015/0286268 | A1* | 10/2015 | Komatsu | G06F 3/04184 345/173 |
| 2016/0035297 | A1* | 2/2016 | Oh | G09G 3/2092 345/212 |
| 2018/0053462 | A1* | 2/2018 | Bae | G09G 3/2074 |

FOREIGN PATENT DOCUMENTS

| | | | |
|---|---|---|---|
| CN | 104916249 | A | 9/2015 |
| CN | 204926764 | U | 12/2015 |
| CN | 106847163 | A | 6/2017 |

OTHER PUBLICATIONS

International Search Report in corresponding PCT application No. PCT/CN2017/107255, dated Jun. 28, 2018.
Written Opinion in corresponding PCT application No. PCT/CN2017/107255, dated Jun. 28, 2018.

* cited by examiner

CIRCUIT BOARD WITH INTER-INTEGRATED CIRCUIT ENCRYPTION AND DISPLAY INCLUDING THE SAME

CROSS-REFERENCE TO RELATED APPLICATION

This application is a national stage of International Application No. PCT/CN2017/107255, filed on Oct. 23, 2017, which claims priority to Chinese Patent Application No. 201710876949.1, filed on Sep. 25, 2017. Both of the aforementioned applications are hereby incorporated by reference in their entireties.

FIELD

The disclosure relates to the field of display technology, and in particular to a circuit board and a display.

BACKGROUND

Thin Film Transistor Liquid Crystal Display (TFT-LCD) is one of the main types of the current flat panel display, and has become an important display platform in modern IT and video products. The main drive principle of TFT-LCD is that the system motherboard connects R/G/B compression signal line, control signal line, and power line with a connector on the Control Board (C-Board), data after process by Timing Controller (TCON) on C-Board is then transmitted to each of the circuit boards, each of the circuit boards connects with the display area, and thereby LCD obtains the required power and signals.

The Inter-Integrated Circuit (I2C) protocol is widely used in the interior of the circuit board of TFT-LCD and the communication process between the circuit board and outside object. The I2C bus transfers information between devices connected to the bus through a serial data line (SDA) and a serial clock line (SCL). Most of the existing product connectors can be shared, but the output settings of the system board may be related to the needs of different customers. Therefore, the system board may not match with the circuit board in the assembly process of system board, and incorrect connection may lead to incorrect operation inside the circuit board, or lead to damage, resulting in poor performance.

SUMMARY

The technical problem to be solved in the present disclosure is how to avoid the damage to the circuit board caused by the mismatch between the system board and the circuit board.

In order to solve the above problems, in one aspect, the present disclosure provides a circuit board, which is applied to a display drive circuit. The display drive circuit includes a system board, a control board and the circuit board, the system board is connected with the control board, the system board sends drive data to the circuit board through the control board, the circuit board includes:

a switch unit, the switch unit being preset with a switch-on signal; the switch unit is configured to connect with the system board, and connecting with the control board through an integrated circuit bus;

when the control signal received from the system board is the same with the switch-on signal, the switch unit is switched on, allowing the circuit board to receive the drive data and work normally; when the control signal received from the system board is not the same with the switch-on signal, the switch unit is switched off, stopping the circuit board from receiving the drive data and resulting in in stoppage of an operation.

In another aspect, the disclosure provides a circuit board, which is applied to a display drive circuit. the display drive circuit includes a system board, a control board and the circuit board, the system board is connected with the control board, the system board sends drive data to the circuit board through the control board, the timing controller includes a serial data output interface and a serial clock output interface, the circuit board includes:

a storage unit, being connected with the serial clock output interface through the serial clock line in the integrated circuit bus;

a switch unit, the switch unit being preset with a switch-on signal; the switch unit includes a plurality of active switches, the active switch being a transistor, the active switch including an input end, an output end and a control end; the control end of each of the active switches is configured to connect with the system board; the input end of a first active switch is configured to connect with the serial data output interface through the serial data line in the integrated circuit bus, and the output end of a previous active switch is connected with the input end of a subsequent active switch from the first active switch, the active switches are connected accordingly until the last active switch, and the last active switch is connected with the storage unit;

when the control signal received from the system board is the same with the switch-on signal, the switch unit is switched on, allowing the circuit board to receive the drive data and work normally; when the control signal received from the system board is not the same with the switch-on signal, the switch unit is switched off, stopping the circuit board from receiving the drive data and resulting in stoppage of an operation.

In still another aspect, the present disclosure provides a display, including a display panel and a display drive circuit, the display drive circuit includes:

N circuit boards, each of the circuit boards including a switch unit, the switch unit of each of the circuit boards being preset with a switch-on signal, and the switch-on signal preset by the switch unit of each of the circuit boards being different from each other;

when the control signal received by a switch unit is the same with the switch-on signal of the switch unit, the switch unit is switched on, allowing the circuit board on which the switch unit locating to receive the drive data and work normally; when the control signal received is not the same with the switch-on signal of the switch unit, the switch unit is switched off, stopping the circuit board on which the switch unit locating from receiving the drive data and resulting in stoppage of an operation.

a control board, being connected with the switch unit of each of the circuit boards through an integrated circuit bus;

N system boards, defined corresponding to each of the circuit boards and being respectively connected with the control board, the system board sending the drive data to the corresponding circuit board through the control board; each of the system boards is connected with the switch unit of the circuit board corresponding to the system board; each of the system boards is configured to send a preset control signal to the switching unit of the circuit board corresponding to the system board; the preset control signal of each of the system boards is different from each other, and is the same only with the switch-on signal of the switch unit of the circuit board which the system board matches;

N is an integer greater than or equal to 1.

By the application of the technical solution of the disclosure, only when the circuit board corresponding to the system board being the one which the system board matches, can the system board switch on the switch unit of the circuit board that the system board correspondents to, then the corresponding circuit board can receive the drive data. When the circuit board corresponding to the system board not being the one which the system board matches, the system board cannot switch on the switch unit of the circuit board that the system board correspondents to, then the corresponding circuit board cannot receive the drive data, thereby avoiding the damage to the circuit board caused by the wrong matching of the system board and the circuit board.

BRIEF DESCRIPTION OF THE DRAWINGS

In order to explain the technical solution of the embodiments of the present disclosure more clearly, the drawings that need to be used in the description of the embodiments will be briefly introduced below. Obviously, the drawings in the following description are some embodiments of the present disclosure. For those of ordinary skill in the art, other drawings can also be obtained according to these drawings without paying creative labor.

DETAILED DESCRIPTION OF THE EMBODIMENTS

Figure 1:
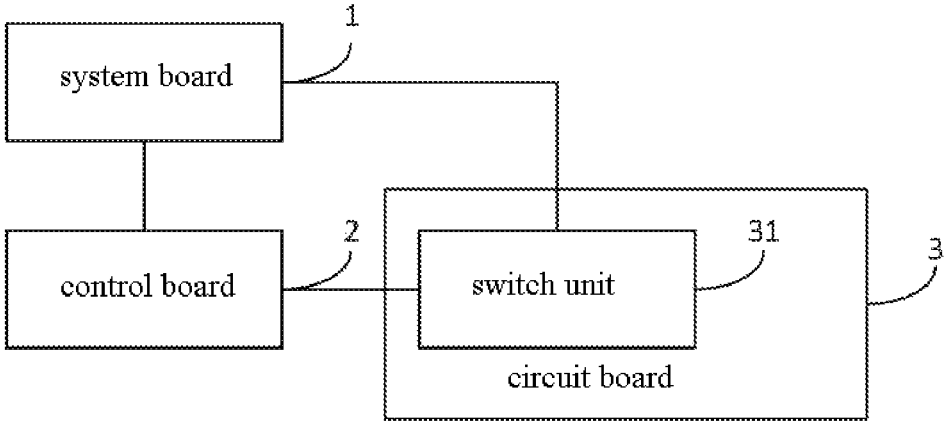
FIG. 1 is a schematic diagram of an application scenario of a circuit board according to an embodiment of the present disclosure.

In the following, the technical solutions in the embodiments will be clearly and completely described with reference to the drawings in the embodiments of the present disclosure, like component numbers in the drawings represent like components. Obviously, the embodiments to be described below are only some embodiments of the present disclosure, not all embodiments. Based on the embodiments in this disclosure, all other embodiments obtained by a person of ordinary skill in the art without creative labor are within the scope of protection of this disclosure.

It should be understood that when used in this specification and the appended claims, the terms "comprising" and "including" indicate the presence of the described features, integers, steps, operations, elements, and/or components, but do not exclude the presence or addition of one or more other features, integers, steps, operations, elements, components, and/or groups thereof.

It should also be understood that the terminology used herein in the description of the embodiments of the present disclosure is for the purpose of describing particular embodiments only and is not intended to limit the embodiments of the present disclosure. As used in the description of the embodiments of this disclosure and the appended claims, the singular forms "a", "an" and "the" are intended to include the plural forms unless the context clearly indicates otherwise.

Referring to FIG. 1, FIG. 1 is a schematic diagram of an disclosure scenario of a circuit board 3 provided in an embodiment of the present disclosure. It can be seen from the figure that the circuit board 3 provided in the present disclosure is applied to a display drive circuit 20, the display drive circuit 20 includes a system board 1, a control board 2 and the circuit board 3. The system board 1 is connected to the control board 2. The system board 1 sends drive data to the circuit board 3 through the control board 2. Specifically, the system board 1 first sends the drive data to the control board 2, and the control board 2 transmits the drive data to the circuit board 3 after processing the drive data. The drive data includes an R/G/B compression signal and a control signal.

The circuit board 3 includes a switch unit 31. It should be noted that, the switch unit 31 is preset with a switch-on signal, when the control signal received by the switch unit 31 being the same with the switch-on signal, the switch unit 31 is switched on, when the control signal received by the switch unit 31 not being the same with the switch-on signal, the switch unit 31 is switched off.

The switch unit 31 is configured to connect with the system board 1 and receive control signals from the control board 1. At the same time, the switch unit 31 is also configured to connect with the control board 2 through an integrated circuit bus. The drive data from the control board 2 needs to pass through the switch unit 31 to reach the circuit board 3.

When receiving the control signal from the system board 1 being the same with the switch-on signal, the switch unit 31 is switched on, allowing the circuit board 3 to receive the drive data and work normally; when receiving the control signal from the system board 1 being not the same with the switch-on signal, the switch unit 31 is switched off, stopping the circuit board 3 from receiving the drive data and resulting in stoppage of an operation.

It should be noted that the control signal output by the system board 1 to the switch unit 31 is preset, and the control signal preset by the system board 1 is only the same with the switch-on signal of the switch unit 31 of the circuit board 3 that matches the system board itself. When the system board 1 does not match the circuit board 3, the control signal from the system board 1 cannot switch on the switch unit 31 of the circuit board 3. Under such situation, the switch unit 31 cannot receive the unmatched drive data, thus avoiding the damage to the circuit board 3 caused by the wrong match.

Figure 2:
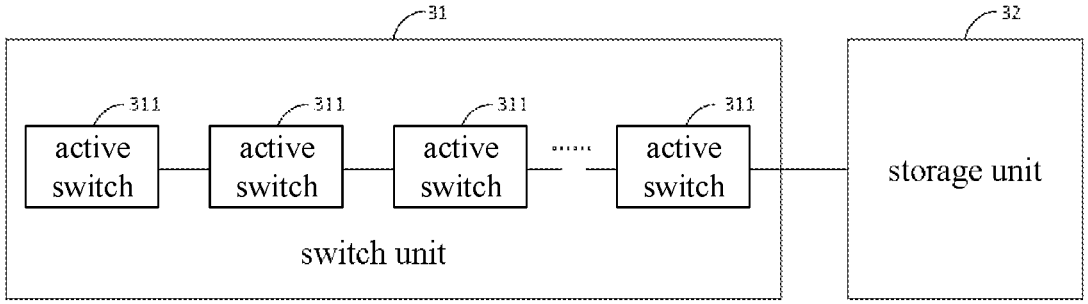
FIG. 2 is a schematic structural diagram of a circuit board according to an embodiment of the present disclosure.

Referring to FIG. 2, in some embodiments, such as this embodiment, the circuit board 3 also includes a storage unit 32, the switch unit 31 includes a plurality of active switch 311, the active switch 311 includes an input end, an output end and a control end.

In the switch unit 31, the control end of each of the active switches 311 is configured to connect with the system board 1; the input end of the first active switch 311 is configured to connect with the control panel 2, and the output end of a previous active switch 311 is connected with the input end of a subsequent active switch 311 from the first active switch 311, the active switches being connected accordingly until the last active switch 311, and the last active switch 311 is connected with the storage unit 32. The switch unit 31 is switched on only when each of the active switches 311 is switched on.

Figure 5:
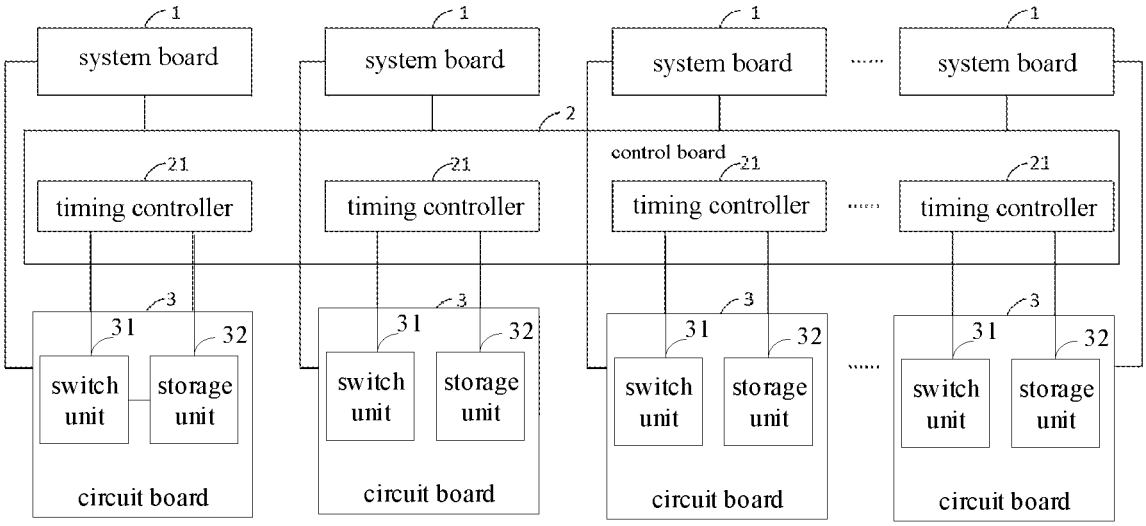
FIG. 5 is a schematic structural diagram of a display drive circuit shown in FIG. 4.

Further, referring to FIG. 5, a timing controller 21 is also provided on the control board 2, the timing controller 21 includes a serial data output interface and a serial clock output interface.

The input end of the first active switch 311 is configured to connect with the serial data output interface through the serial data line in the integrated circuit bus.

The storage unit 32 is configured to connect with the serial clock output interface through the serial clock line in the integrated circuit bus.

Figure 3:
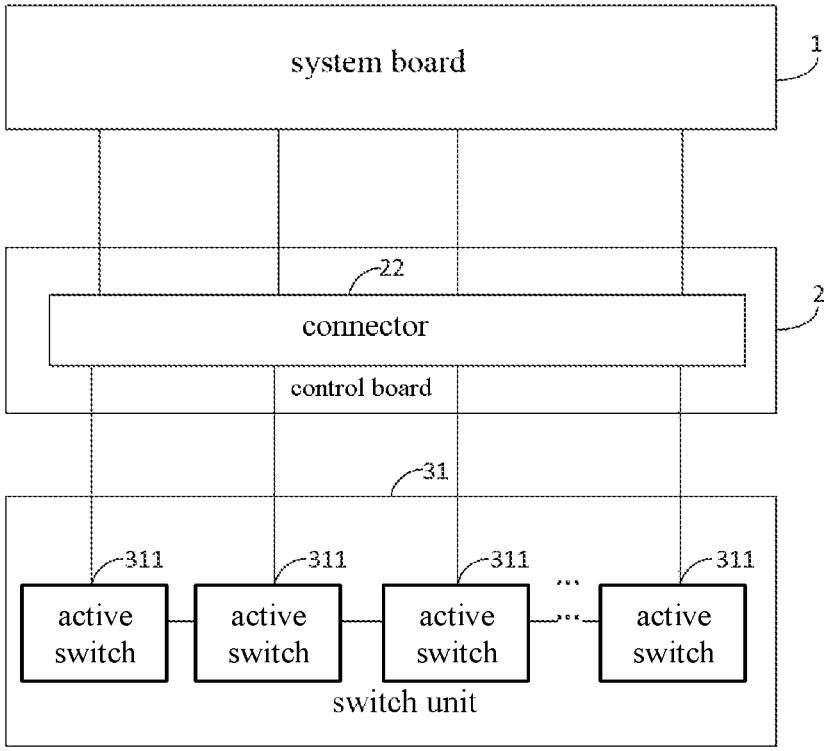
FIG. 3 is a schematic diagram of the connection between the switch unit and the system board according to the embodiment of the present disclosure.

Further, referring to FIG. 3, a connector 22 is also provided on the control board 2. In the switch unit 31 of the circuit board 3, the control end of each of the active switches 311 is configured to connect with the connector 22 on the control board 2 and then to connect to the system board 1 through the connector 22.

Further, the active switch 311 may be a transistor and is not limited here. Specifically, it may be a MOS tube (metal-oxide-semiconductor-field-effect transistor) or a triode.

Further, the switching unit 31 includes four of the active switches 311. For example, the switching unit 31 includes four MOS transistors.

Figure 4:
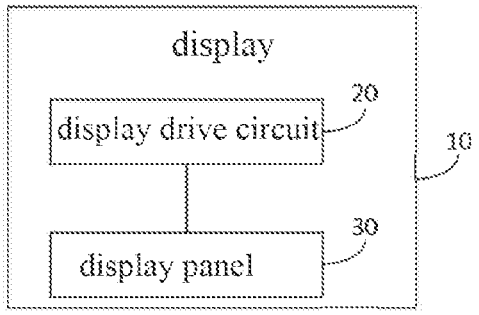
FIG. 4 is a schematic structural diagram of a display provided in an embodiment of the present disclosure.

Referring to FIGS. 4-5, there is provided a display 10 according to an embodiment of the present disclosure, as can be seen from the figures, the display 10 includes a display panel 30 and a display drive circuit 20, the display drive circuit 20 includes N system boards 1, control boards 2, and N circuit boards 3 corresponding to each of the system boards 1 respectively, the N is an integer greater than or equal to 1. Each of system boards 1 is connected to a control board 2, and each of the system boards 1 sends drive data to its corresponding circuit board 3 through the control board 2.

Each of the circuit boards 3 includes a switch unit 31, the switch unit 31 of each of the circuit boards 3 is preset with a switch-on signal, and the switch-on signal preset by the switch unit 31 of each of the circuit boards 3 is different from each other. When the control signal received by the switch unit 31 is the same with the switch-on signal, the switch unit 31 is switched on, and when the control signal received by the switch unit 31 is not the same with the switch-on signal, the switch unit 31 is switched off.

The control board 2 is connected to the switch unit 31 of each of the circuit boards 3 through an integrated circuit bus. Only when the switch unit 31 of the circuit board 3 is switched on can the circuit board 3 normally receive drive data from the control board 2. Each of the system boards 1 is connected to the switch unit 31 of the circuit board 3 which corresponds to the system board, and can send a control signal to the switch unit 31.

Each of the system boards 1 is configured to send a control signal to the switching unit 31 of the circuit board 3 which corresponds to the system board. It should be noted that the control signal of each of the system boards 1 is preset, and the preset control signal can only be the same with the switch-on signal of the switch unit 31 of the circuit board 3 matching the system board. That is, the control signal of each of the system boards 1 can only switch on the switch unit 31 of the circuit board 3 matching the system board. At the same time, the control signals preset by each circuit board are different from each other.

When the received control signal is the same with the switch unit switch-on signal, the switch unit 31 of each of the circuit boards 3 is switched on, allowing the circuit board 3 where the switch unit 31 is defined to receive the drive data and work normally; when the control signal received is not the same with the switch unit switch-on signal, the switch unit 31 of each of the circuit boards 3 is switched off, stopping the circuit board on which the switch unit locating from receiving the drive data and resulting in stoppage of an operation.

According to the above arrangement, only when the circuit board 3 corresponding to the system board 1 is its matching circuit board 3, can the system board 1 switch on the switching unit 31 of the circuit board 3 corresponding to the system board. Furthermore, the corresponding circuit board 3 can receive the drive data. When the circuit board 3 corresponding to the system board 1 is not its matching circuit board 3, the system board 1 cannot switch on the switching unit 31 of the circuit board 3 corresponding to the system board, disallowing the corresponding circuit board 3 to receive drive data, and thereby avoiding the damage to the circuit board 3 caused by the wrong matching of the system board 1 and the circuit board 3.

Referring to FIG. 2, in some embodiments, such as this embodiment, the circuit board 3 includes a storage unit 32, the switch unit 31 of the circuit board 3 includes a plurality of active switches 311, the active switch 311 includes an input end, an output end and a control end.

In the switch unit 31 of the circuit board 3, the control end of each of the active switches 311 is connected to the corresponding system board 1; The input end of the first active switch 311 is configured to connect with the control board 2, and the output end of a previous active switch 311 is connected with the input end of a subsequent active switch 311 from the first active switch 311, the active switches being connected accordingly until the last active switch 311, and the last active switch 311 is connected with the storage unit 32.

Referring to FIG. 5, further, the control board 2 includes N timing controllers 21 corresponding to the circuit boards 3 respectively, the timing controller 21 includes a serial data output interface and a serial clock output interface, the serial data output interface of the timing controller 21 is connected to the switching unit 31 of the circuit board 3 corresponding to itself through the serial data line in the integrated circuit bus, the serial clock output interface of the timing controller 21 is connected to the storage unit 32 of the circuit board 3 corresponding to itself through the serial clock line in the integrated circuit bus.

In some embodiments, the display panel 30 of the above display 10 may be, for example, a twisted nematic liquid crystal display panel, a planar conversion liquid crystal display panel, a multi-quadrant vertical alignment liquid crystal display panel, an OLED display panel, a QLED display panel, or other display panels.

In the above embodiments, the description of each embodiment has its own emphasis. For those parts of one embodiment that are not described in detail, please refer to the relevant descriptions of other embodiments.

As described above, this is the specific embodiment of this disclosure, but the scope of protection of this disclosure is not limited thereto. Any person skilled in the art can easily think of various equivalent modifications or substitutions within the technical scope disclosed in this disclosure, and these modifications or substitutions should be covered within the scope of protection of this disclosure. Therefore, the scope of protection of this disclosure shall be subject to the scope of protection of the claims.

What is claimed is:

1. A circuit board, applied to a display drive circuit, the display drive circuit comprising a system board, a control board, and the circuit board, the system board being connected with the control board, and the system board sending drive data to the circuit board through the control board, the circuit board comprising:

a switch unit being preset with a switch-on signal and configured to connect with the system board, and connect with the control board through an integrated circuit bus, wherein: when the control signal received from the system board is the same with the switch-on signal, the switch unit is switched on, allowing the circuit board to receive the drive data and work normally; and when the control signal received from the system board is not the same with the switch-on signal, the switch unit is switched off, stopping the circuit board from receiving the drive data and making the circuit board to stoppage of an operation, wherein the circuit board further comprises a storage unit, and wherein: the switch unit comprises a plurality of active switches and each of the active switches comprises an input end, an output end, and a control end; the control end of each of the active switches is configured to connect with the system board; and the input end of a first active switch is configured to connect with the control board, and the output end of a previous active switch is connected with the input end of a subsequent active switch from the first active switch, the active switches are connected accordingly until the last active switch, and the last active switch is connected with the storage unit.

2. The circuit board of claim 1, wherein the active switch is a transistor.

3. The circuit board of claim 2, wherein the active switch is a metal-oxide-semiconductor-field effect transistor.

4. The circuit board of claim 2, wherein the active switch is a triode.

5. The circuit board of claim 1, wherein the switch unit comprises four of the active switches.

6. The circuit board of claim 1, wherein:

the control board comprises a timing controller, the timing controller comprises a serial data output interface and a serial clock output interface; and the input end of the first active switch is configured to connect with the serial data output interface through the serial data line in the integrated circuit bus.

7. The circuit board of claim 1, wherein:

the control board comprises a connector; and the control end of each of the active switches is configured to connect with the system board through the connector.

8. The circuit board of claim 1, wherein the drive data comprises an R/G/B compression signal and a control signal.

9. A display, comprising:

a display panel; and a display drive circuit, the display drive circuit comprising:

N circuit boards, each of the circuit boards comprising a switch unit, the switch unit of each of the circuit boards being preset with a switch-on signal, and the preset switch-on signal of the switch unit of each of the circuit boards being different from each other, wherein: when the control signal received by the switch unit is the same with the switch-on signal of the switch unit, the switch unit is switched on, allowing the circuit board on which the switch unit locating to receive the drive data and work normally; and when the control signal received by a switch unit is not the same with the switch-on signal of the switch unit, the switch unit is switched off, stopping the circuit board on which the switch unit is located from receiving the drive data and making the circuit board to stoppage of an operation;

a control board connected with the switch unit of each of the circuit boards through an integrated circuit bus; and N system boards, defined corresponding to each of the circuit boards and being respectively connected with the control board, wherein: each of the system boards sends the drive data to the corresponding circuit board through the control board; each of the system boards is connected with the switch unit of each of the circuit boards corresponding to each of the system boards; each of the system boards is configured to send a preset control signal to the switch unit of each of the circuit boards corresponding to each of the system boards; and the preset control signal of each of the system boards is different from each other, and is the same only with the switch-on signal of the switch unit of each of the circuit boards with which each of the system boards matches, wherein N is an integer not less than 1.

10. The display of claim 9, wherein the circuit board further comprises a storage unit, and wherein: the switch unit comprises a plurality of active switches and each of the active switches comprises an input end, an output end and a control end; the control end of each of the active switches is configured to connect with each of the system boards; and the input end of a first active switch is configured to connect with the control board, and the output end of a previous active switch is connected with the input end of a subsequent active switch from the first active switch, the active switches are connected accordingly until the last active switch, and the last active switch is connected with the storage unit.

11. The display of claim 10, wherein:

the control board comprises a timing controller, the timing controller comprises a serial data output interface and a serial clock output interface; and the input end of the first active switch is configured to connect with the serial data output interface through the serial data line in the integrated circuit bus.

12. The display of claim 10, wherein:

the control board comprises a connector; and the control end of each of the active switches is configured to connect with the system board through the connector.

13. The display of claim 10, wherein the active switch is a transistor.

14. The display of claim 13, wherein the active switch is a metal-oxide-semiconductor-field effect transistor.

15. The display of claim 10, wherein the switch unit comprises four of the active switches.

16. The display of claim 9, wherein the drive data comprises an R/G/B compression signal and a control signal.

17. A circuit board, applied for a display drive circuit, the display drive circuit comprising a system board, a control board and the circuit board, the system board being connected with the control board, the system board sending drive data to the circuit board through the control board, the control board comprising a timing controller, and the timing controller comprising a serial data output interface and a serial clock output interface, the circuit board comprising:

a storage unit being connected with the serial clock output interface through the serial clock line in the integrated circuit bus;

a switch unit, the switch unit being preset with a switch-on signal; wherein: the switch unit comprises a plurality of active switches, each of the active switches is a transistor, and each of the active switches comprises an input end, an output end and a control end; the control end of each of the active switches is configured to connect with the system board; the input end of a first active switch is configured to connect with the serial data output interface through the serial data line in the integrated circuit bus, and the output end of a previous active switch is connected with the input end of a subsequent active switch from the first active switch, the active switches are connected accordingly until the last active switch, and the last active switch is connected with the storage unit, and wherein: when the control signal received from the system board is the same with the switch-on signal, the switch unit is switched on, allowing the circuit board to receive the drive data and work normally; and when the control signal received from the system board is not the same with the switch-on signal, the switch unit is switched off, stopping the circuit board from receiving the drive data and resulting in stoppage of an operation.

* * * * *